United States Patent [19]

Nath et al.

[11] Patent Number: 4,672,983

[45] Date of Patent: Jun. 16, 1987

[54] HAIR COLORING

[76] Inventors: Narender K. Nath; Monmohan K. Nath, both of 224 Shaftesbury Ave., London, England

[21] Appl. No.: 657,073

[22] Filed: Oct. 2, 1984

[30] Foreign Application Priority Data

| | | | |
|---|---|---|---|
| Oct. 3, 1983 | [GB] | United Kingdom | 8326432 |
| Nov. 3, 1983 | [GB] | United Kingdom | 8329329 |
| Nov. 7, 1983 | [GB] | United Kingdom | 8329690 |

[51] Int. Cl.[4] ..... A45D 7/00

[52] U.S. Cl. ..... 132/7

[58] Field of Search ..... 132/7, 40, 39, 43 R, 132/42

[56] References Cited

U.S. PATENT DOCUMENTS

| | | | |
|---|---|---|---|
| 2,889,834 | 6/1959 | Anderson et al. | 132/43 R |
| 3,545,457 | 12/1970 | Schepis | 132/40 |
| 3,692,032 | 9/1972 | Regas | 132/9 |
| 3,943,946 | 3/1976 | Gallegos | 132/39 |

*Primary Examiner*—Gregory E. McNeill

*Attorney, Agent, or Firm*—Wood, Herron & Evans

[57] ABSTRACT

Means is described for performing a hair coloring treatment, such as tinting or bleaching, on a section of head hair and comprises a sheet of material capable of being folded around a section of hair to be treated. The sheet consists of plastics material and is re-usable in contradistinction to previously used aluminium foil. The sheet is also preferably transparent so that a hair coloring treatment can be monitored. At least one bendable inclusion in mesh, wire or strip form is embedded in or affixed to the sheet material, the bendable inclusion(s) having such bendability and rigidity that, when the sheet of plastics material is folded generally along predetermined fold lines over and about a section of hair to be treated with treatment material in paste or like form applied to the section thereby to form a generally closed pocket, the said inclusion(s) in bent form serve(s) to maintain the configuration of the pocket at least for a time sufficient to perform the coloring treatment.

10 Claims, 9 Drawing Figures

HAIR COLORING

FIELD OF THE INVENTION

This invention is concerned with hair colouring.

BACKGROUND OF THE INVENTION

In so-called "advanced hair colouring", sections of the hair are subjected to a colouring treatment (which term is here used to encompass "bleaching" in addition to "tinting") without treating the remainder of the head of hair. One such conventional process is that known as "foil highlighting" in which strips of aluminium foil detached from a roll of such foil are folded around the section of hair to be treated together with the treating materials in paste form. Foil highlighting is very widely employed but suffers from a number of disadvantages. The foil can be used once only. The pieces of foil for each highlighting need to be prepared in advance. There is a tendency for leakage to occur unless the treatment is carefully carried out by someone with experience. The progress of the treatment cannot be followed and since there is a range of response with different hair types to the treatment materials, to ensure the treatment is completed, the materials are left in contact with the sections of hair concerned for longer than might be necessary. Lengthy and repeated exposure of hair to the materials conventionally employed will eventually damage the structure of the hair. It would therefore be desirable to maintain contact between the materials and the individual sections of hair for the minimum time that was necessary.

BRIEF SUMMARY OF THE INVENTION

Despite these evident disadvantages of the conventional foil highlighting treatment, there has, to date, been no satisfactory alternative. The present invention seeks to provide such an alternative.

In accordance with one aspect of the present invention, there is provided means for performing a hair colouring treatment on a section of head hair, comprising a sheet of material capable of being folded around a section of hair to be treated together with a treatment material in paste or like form, characterised in that the sheet consists of plastics material which is re-usable, and in that at least one bendable inclusion in mesh, wire or strip form is embedded in or affixed to the plastics sheet material, the bendable inclusion(s) having such bendability and rigidity that, when the sheet of plastics material is folded generally along predetermined fold lines over and about a section of hair to be treated with the treatment material applied thereto to form a generally closed pocket, the said inclusion(s) in bent form serve(s) to maintain the configuration of the pocket at least for a time sufficient to perform the colouring treatment.

In a second and alternative aspect of the present invention there is provided a method of performing a hair colouring treatment on a section of head hair, comprising laying the said section of head hair to be treated across a sheet of material, applying colouring treatment material in paste or like form thereto, folding the sheet of material to form a generally closed pocket about the section of hair, and maintaining the pocket in its closed configuration for at least a time sufficient to perform said hair treatment, characterised in that said sheet of material consists of plastics material which is re-usable. The method is conveniently carried out on the said section of hair to be treated using the means just indicated.

The plastics material for use in hair colouring treatment in accordance with the present invention is desirably transparent, so enabling the progress of the treatment to be monitored by simple visual inspection. When the desired tint or the desired degree of bleach is achieved, the treatment can be terminated without delay. There is a wide choice of suitable plastics materials for the sheet. However, in order that the sheet should be capable of folding generally along predetermined fold lines, the material should have some degree of rigidity in addition to its inherent flexibility so that, having once been folded and then unfolded, the positions of the crease lines remain sufficiently visible that when the sheet comes to be re-used in a further colouring treatment, it may simply be folded along the pre-existing crease lines. The plastics material should of course be chosen so as to avoid complications of chemical reactions with the materials being used.

Suitable plastics material from which sheet may be made include polyvinyl chloride, polyethylene and polypropylene. A preferred material is transparent polyvinyl chloride sheet of 4000 gauge thickness, but coloured or tinted sheets of greater or lesser thickness may be used.

As to the inclusions, these may be integrally moulded into the plastics sheet when formed. Alternatively, they may be applied to one side of the sheet (the side which in practice will not be in contact with the hair) by means of adhesive or the like. As we shall explain below, the configuration of the plastics sheet may take various forms, as may the inclusions. Examples of inclusions in mesh, wire and strip form are given below with reference to the accompanying drawings.

When performing a method in accordance with the present invention, as an addition to or as an alternative to the use of bendable inclusions, clips may be used to ensure that the configuration of the treatment pocket is maintained. Alternatively, the bendable inclusions may comprise or consist of or be partly replaced by magnetic means so that the maintenance of the pocket configuration may be effected or enhanced by magnetic forces.

In a further embodiment, the sheet is provided with a flap which is loose at one end and which is attached to or integral with an edge of the main sheet of plastics material at the other, the flap being preferably located between an intended first fold line of the sheet and the end of the plastics sheet material which, in use, is intended to be adjacent the roots of the section of hair to be treated. The said flap is laid across the section of hair being treated after the application of the treatment materials and before the first fold. It has been found that this arrangement serves better to distribute the treatment materials over the whole of the section of hair being treated. The main advantage, however, is that by providing an additional edge about which the hair extends when the sheet of plastics material is fully folded to form the pocket configuration, the simple addition of this flap greatly reduces any tendency to slippage (that is of the hair becoming loose and sliding out of the folded sheet of plastics material). Furthermore, the presence of the flap enables part of the section of hair to be treated to be kept free of colouring treatment material to enable the part to remain uncoloured.

The various embodiments of means for performing a hair colouring treatment on a section of head hair are intended to be re-usable possibly as often as 50 times.

Where bendable inclusions are present, they may weaken slightly over time. The treatment materials themselves tend to be slippery so that, regardless of weakening of the bendable inclusions, there is an increased tendency to slippage with each re-use. Both of these effects tends to limit the useful life, and we have found that the simple incorporation of the aforementioned flap enables the useful life to be much prolonged.

DESCRIPTION OF THE DRAWINGS

The invention is hereinafter more particularly described with reference to the accompanying drawings, in which.

Figure 1:
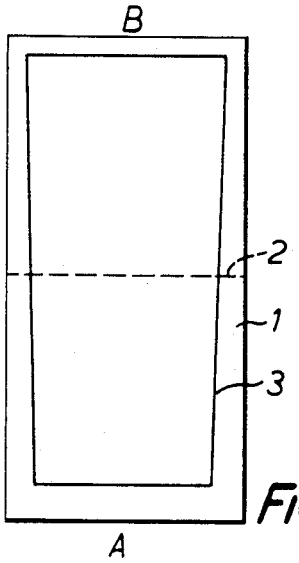
FIG. 1 is a plan view of a first embodiment of means in accordance with the present invention for performing a hair colouring treatment.
Figure 2:
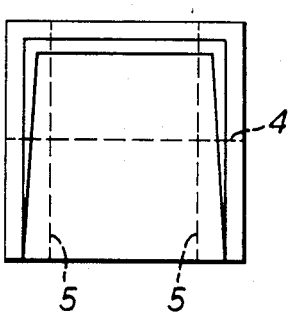
FIG. 2 shows the sheet of FIG. 1 after its first fold.

As will be seen from FIG. 1 of the accompanying drawings, means for performing a hair colouring treatment on a section of hair comprises a sheet 1 of a suitable plastics material along which a length of hair may be placed with the end A of the strip against the scalp and the length of hair laid along the sheet from end A to end B. Treatment materials, such as bleach in paste form, are applied to the length of hair and the sheet 1 is folded in half along the fold line generally indicated at 2 to form the configuration shown in FIG. 2. The sheet 1 is integrally provided with an inclusion which has greater rigidity than the sheet itself but which is bendable in the sense that, when bent, it retains the position into which it has been bent. The inclusion 3 of the embodiment of FIGS. 1 and 2 comprises a wire which extends essentially along each of the four sides of the strip but inset somewhat from the marginal edge and adjacent thereto. For a reason to be explained, it will be seen that the wire does not run exactly parallel to the longer marginal edges of the strip but extends at a slight angle. Thus, when the sheet is folded in half as shown in FIG. 2, the lengths of wire, which otherwise would coincide exactly when the sheet is folded in half, lie alongside each other. We find that this assists in avoiding leakage and in maintaining the pocket, in which the hair and treatment materials are located in practice of the method, generally closed. It will also be noted that the wires at the respective ends A and B of the sheet are at different separations or spacings from the adjacent marginal edge. Again, this ensures that the wires run alongside each other rather than coinciding, again as will become apparent from FIG. 2.

After the first fold to form the configuration shown in FIG. 2, the sheet is again folded in half along the fold line indicated at 4. Finally, the edges are folded over generally along the lines 5. It has been found that by suitable choice of the material of the plastics sheet, particularly with regard to its thickness and flexibility, and by suitable choice of the wire inclusion 3, the pocket will maintain its fully folded configuration without the need for any auxiliary clip. However, the present invention contemplates as an alternative to or an addition to the employment of the integrally provided bendable inclusion, when an enhanced security of maintenance of the closed pocket is required, that clips of a kind conventionally used by hairdressers may be employed.

Though it is greatly preferred that the plastics material 1 be transparent in order that the progress of the hair colouring treatment may be monitored so as to terminate it as soon as the section of hair reaches the required tint or the required degree of bleaching, this is not absolutely essential and it would be possible to derive the remaining benefits of this invention by employing an opaque plastics sheet.

It is preferred that the wire 3 should be integrally moulded into the material of the plastics sheet when the sheet is produced, though again this is not absolutely essential. Simple experimentation will enable the skilled man to decide which wires are suitable for the purpose. It has been found that a simple prototype means for performing a hair colouring treatment in accordance with the present invention can be provided simply by adhering a piece of insulation-covered copper electrical wire to a plastics sheet in the configuration shown in FIG. 1. Even this rudimentary prototype has the advantages that it may be repeatedly re-used; having once been folded along predetermined fold lines, the crease lines remain noticeable after unfolding enabling the sheet to be re-used by being folded along essentially the same lines without the hairdresser needing to have the advance skills required for foil highlighting. After use, the sheet is simply washed and then re-used unlike the aluminium foil for conventional foil highlighting which cannot be re-used.

Preferably, however, the material used for the inclusion 3 is thin plastics coated wire of the kind used for horticultural and gardening purposes. This material is designed to be readily and repeatedly bendable and is eminently suitable for the present purposes. As will be appreciated, one effect of including a wire such as that at 3 is to rigidify the sheet as a whole to the extent that it can readily be held in one hand without flopping while the section of hair is laid therealong.

The invention is not limited to the particular configuration of sheet and inclusion shown in FIG. 1.

Figure 3:
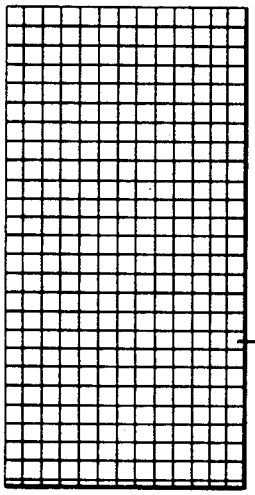
FIG. 3 is a view generally similar to FIG. 1 of an alternative embodiment also in accordance with the present invention.

Thus, in FIG. 3 the bendable inclusion is effectively provided throughout the whole of the platics sheet and in the form of a wire mesh 6. This arrangement has certain manufacturing advantages in that the plastics material can be continuously formed on a roll with the wire mesh moulded in situ therein or interleaved between two sheets of plastics material. The continuous length is cut into sheets of appropriate size and configuration for use in the method of the present invention.

Figure 4:
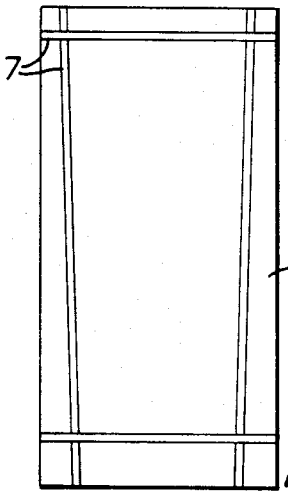
FIG. 4 shows a yet further embodiment also in accordance with the present invention and in a view generally similar to that of FIGS. 1 and 3.

Both the embodiment of FIGS. 1 and 2 and the embodiment of FIG. 3 employ an inclusion in wire form. Bendable metal strips 7 as shown in FIG. 4 can be used as an alternative.

Figure 5:
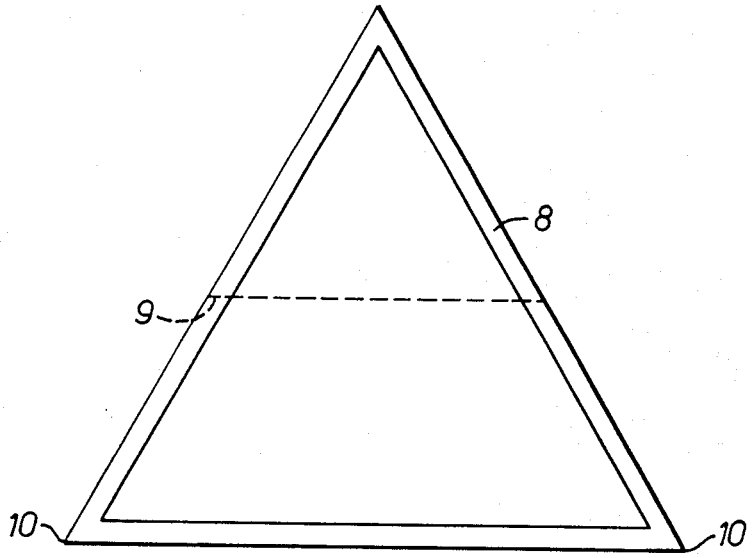
FIG. 5 is a plan view of a yet further alternative embodiment of means in accordance with the present invention for performing a hair colouring treatment.

As a further example that the invention is not limited to any particular configuration for the sheet 1, FIG. 5 shows a sheet 8 in generally triangular form. The first fold line is indicated at 9, after which the remaining two corners 10 may be similarly folded in. In order to complete the pocket, the corners of the smaller triangle which then remains may be similarly folded in.

However, the configuration shown in FIGS. 1 and 2 has the advantage that it can be used when hair which has previously been bleached or tinted has grown and the roots require to be re-bleached or re-tinted. The sheet 1 is used on its side with the hair laid across from one longitudinal edge to the other so that only the root end of the hair falls within the resultant pocket produced by folding up the sheet.

Figure 6:
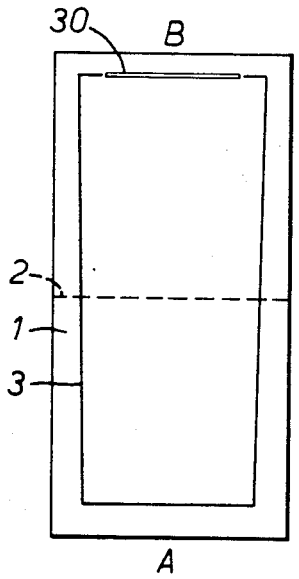
FIG. 6 is a plan view of another embodiment of means in accordance with the present invention for performing a hair colouring treatment.
Figure 7:
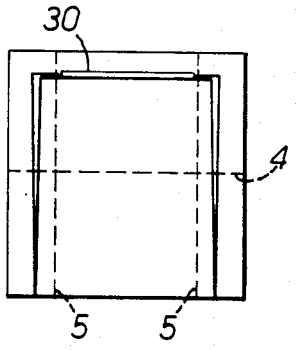
FIG. 7 shows the sheet of FIG. 6 after its first fold.

The hair colouring treatment means illustrated in FIGS. 6 and 7 is similar to that shown in FIGS. 1 and 2. It also comprises a sheet 1 of a suitable plastics material along which a length of hair may be placed from the end A of the strip against the scalp and the length of the hair laid along the sheet from end A to end B. Treatment materials, such as bleach in paste form, are applied to the length of hair and the sheet 1 is folded in half along the fold line generally indicated 2 to form the configuration shown in FIG. 7.

In this embodiment the sheet 1 is provided with an inclusion 3 which has greater rigidity than the sheet itself but which is bendable, essentially in the same manner as in the embodiment of FIGS. 1 and 2. The inclusion 3 comprises a wire which extends essentially along three of the four sides of the strip but inset somewhat from the marginal edge. As in the embodiment of FIGS. 1 and 2 the wire does not run exactly parallel to the longer marginal edges of the strip but extends at a similar slight angle. Thus, when the sheet is folded in half as shown in FIG. 7, the lengths of wire which otherwise would coincide exactly when the sheet is folded in half, lie alongside each other.

Along the fourth side of the strip, in place of the wire 3 is affixed or embedded a magnetic strip or rod 30. The wire 3 is suitably formed of steel or iron wire (that is of a ferromagnetic material) and accordingly when the sheet 1 is folded into the configuration shown in FIG. 7, the surperimposed sheet ends A and B are held together by magnetic forces between the wire 3 and the magnetic rod or strip 30.

Other arrangements employing magnetic means are possible. In the illustrated embodiment, only part of the bendable inclusion is replaced by a magnet. However, in other embodiments, the whole of the bendable inclusion could be replaced by magnets. Where these are rigid (that is in rod form), they must be such as not to extend across the intended fold lines 2, 4 and 5 since otherwise the sheet cannot be folded as intended. The magnetic inclusions may, however, be of bendable wire or strip form, though still magnetized, in which case they can have a configuration exactly as shown in FIGS. 1, 4 or 5 (for example).

Figure 8:
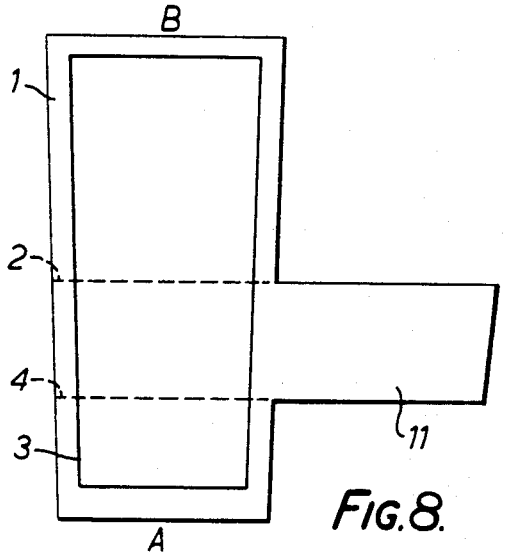
FIG. 8 is a plan view of yet another embodiment of means in accordance with the present invention for performing a hair colouring treatment.

The hair colouring treatment means illustrated in FIG. 8 also comprises a sheet 1 of a suitable plastics material along which a length of hair may be placed from the end A of the strip against the scalp. The length of the hair is laid along the sheet from end A to end B. Treatment materials, such as bleach in paste form, are applied to the length of hair and the sheet 1 is folded in half along the fold line generally indicated at 2.

In this embodiment the sheet 1 is provided with an inclusion 3 in the form of a wire which has greater rigidity than the sheet itself but which is bendable, essentially in the same manner as in the embodiment of FIGS. 1 and 2. A magnetic inclusion (not illustrated) could also or alternatively be included as described above.

It will be seen that in the embodiment illustrated in FIG. 8, the whole strip is slightly tapered from one end to the other, the purpose being the same as the slight angle of the wire to the longer marginal edges of the strip in the illustrated embodiments of FIGS. 1 and 2.

In the embodiment of FIG. 8, however, it will be seen that there is an additional flap 11 which extends between the position 2 for the first fold and the position 4 for the second fold and is on the side of fold 2 closer to the hair roots in use. This flap may be a simple extension to the side of the main sheet 1 or may be a further section of the same or a different plastics material affixed to the first strip 1 at its marginal edge.

At any event, when the hair is placed in position along the sheet 1, the flap 11 is folded over to extend thereacross. The main sheet is then folded in half at 2, and again at 4. Finally, the edges are folded inwardly as described above.

Figure 9:
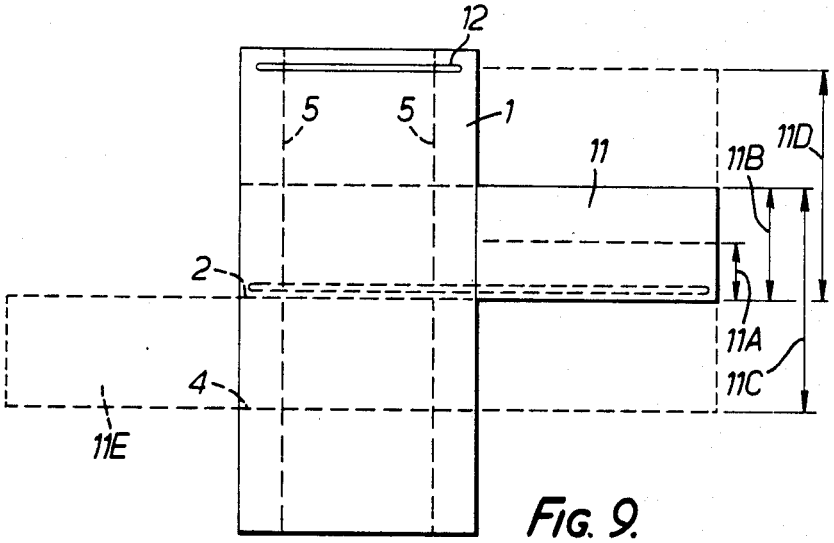
FIG. 9 is a plan view of a modification of the means shown in FIG. 8.

In the embodiment of FIG. 9, the wire inclusion 3 extending adjacent the marginal edges of the sheet 1 of the embodiment of FIG. 8 is replaced by a bendable metallic strip 12 and the sheet is formed or provided with an additional flap 11 as in the embodiment of FIG. 8. However, in this embodiment, the sheet 1 may be rectangular and not tapered. As with the embodiment of FIG. 8, the flap is folded to extend across a section of hair placed in position along the sheet 1 which is then folded along the lines 2, 4 and 5, the last fold serving to bend the ends of the strip 12 to hold the resulting pocket in its closed configuration.

As shown in FIG. 9, the flap 11 may take several forms and its dimension in the length direction of the sheet may be 11B, in which case the flap is similar to that shown in FIG. 8, or it may be half this dimension, 11A or twice this dimension, or 11C, 11D. If desired, a further flap 11E may be provided on the other side of the sheet as shown. It is thus clear that the shape, size and position of the flap may be varied and will be chosen in accordance with requirements.

If desired the flap 11 may have a bendable inclusion 12A embedded in or affixed to it, and in one embodiment the bendable inclusion 12A is in the form of a bendable metallic strip coated with plastics material and serves in place of the flap 11.

We claim:

1. Means for performing a hair coloring treatment on a section of head hair, comprising a sheet of material capable of being folded around a section of hair to be treated together with a treatment material in paste or like form, characterised in that the sheet consists of plastics material which is re-usable, and in that at least one bendable inclusion in mesh, wire or strip form is embedded in or affixed to the plastics sheet material, the bendable inclusion(s) having such bendability and rigidity that, when the sheet of plastics material is folded generally along predetermined fold lines over and about a section of hair to be treated with the treatment material applied thereto to form a generally closed pocket, the said inclusion(s) in bent form serve(s) to maintain the configuration of the pocket at least for a time sufficient to perform the coloring treatment.

2. Means as claimed in claim 1, wherein the means is provided with a bendable inclusion in the form of a bendable metallic strip adjacent one edge of the sheet.

3. Means as claimed in claim 1, wherein the means is provided with one or more bendable inclusions adjacent each edge of the sheet.

4. Means as claimed in claim 3, wherein the sheet is substantially rectangular, and wherein the bendable inclusions at each edge are inclined to one another and the inclusions at each end are at different spacings from the ends, whereby when the sheet is folded in half from end to end the bendable inclusions do not coincide.

5. Means as claimed in claim 3, wherein the sheet is substantially triangular.

6. Means as claimed in any one of claims 3 to 5, wherein the bendable inclusion is in the form of a bendable metallic wire or wire mesh.

7. Means as claimed in any preceding claim, wherein the sheet is provided with a flap which is loose at one end and which is attached to or integral with an edge of the sheet at the other, the flap preferably being located between an intended first fold line of the sheet and the end of the sheet which, in use, is intended to lie adjacent the roots of the section of hair to be treated.

8. Means as claimed in any preceding claim, wherein the sheet consists of transparent plastics material.

9. A method of performing a hair colouring treatment on a section of head hair, comprising laying the said section of head hair to be treated across a sheet of material, applying colouring treatment material in paste or like form thereto, folding the sheet of material to form a generally closed pocket about the section of hair, and maintaining the pocket in its closed configuration for at least a time sufficient to perform said hair treatment, characterised in that said sheet of material consists of plastics material which is re-usable.

10. A method as claimed in claim 9, wherein the colouring treatment on the section of head hair is carried out using the means claimed in any one of claims 1 to 8.

* * * * *